United States Patent [19]

Deaton

[11] Patent Number: 4,836,718

[45] Date of Patent: Jun. 6, 1989

[54] EARTH RETAINING METHOD AND STRUCTURE WITH IMPROVED CORROSION PROTECTION AND DRAINAGE

[75] Inventor: Hubert Deaton, Plano, Tex.

[73] Assignee: Schnabel Foundation Company, Bethesda, Md.

[21] Appl. No.: 171,377

[22] Filed: Mar. 21, 1988

[51] Int. Cl.[4] ..... E02D 5/20; E02D 24/00

[52] U.S. Cl. ..... 405/262; 405/258; 405/284

[58] Field of Search ..... 405/262, 258, 284, 287, 405/286, 285, 107, 109

[56] References Cited

U.S. PATENT DOCUMENTS

| | | | |
|---|---|---|---|
| 2,000,492 | 5/1935 | McKeen | 405/262 |
| 2,184,974 | 12/1939 | Henderson | 405/287 X |
| 3,345,824 | 10/1967 | Turzilio . | |
| 3,420,065 | 1/1969 | Holl | 405/284 |
| 3,438,207 | 4/1969 | Turzillo | 405/287 |
| 3,521,454 | 7/1970 | Dodds . | |
| 4,329,089 | 5/1982 | Hilfiker et al. | 405/287 X |
| 4,369,004 | 1/1983 | Weatherby | 405/262 |
| 4,407,612 | 10/1983 | van Weele . | |
| 4,626,133 | 12/1986 | Waring | 405/107 |
| 4,653,962 | 3/1987 | McKittrick et al. | 405/262 X |
| 4,659,252 | 4/1987 | Sexton et al. | 405/109 |

*Primary Examiner*—Dennis L. Taylor

*Attorney, Agent, or Firm*—Banner, Birch, McKie & Beckett

[57] ABSTRACT

A tieback retaining wall structure and a method for constructing the same having improved corrosion protection for tieback connecting devices connecting tiebacks to soldier beams, and panel connecting devices connecting precast concrete panels to soldier beams is disclosed. The structure also provides an improved and simpler method of drainage behind a wall. After soldier beams are placed in the earthen mass to be retained, excavation is completed, tiebacks are installed and fastened, and any necessary temporary earth retaining devices are in place, elongated inflatable bags are positioned between the excavation and the precast concrete panels. Then the concrete panels are attached to the soldier beams. The bags preferably are inflated with a cementitious material which forms a sealed first channel surrounding the tieback connecting devices and the panel connecting devices, and a second channel between adjacent beams. The first channel is filled with a cementitious material. The second channel is filled with drainage material.

18 Claims, 2 Drawing Sheets

EARTH RETAINING METHOD AND STRUCTURE WITH IMPROVED CORROSION PROTECTION AND DRAINAGE

TECHNICAL FIELD

The present invention pertains to earth retaining structures. More particularly, the present invention pertains to an earth retaining structure including a soldier beam wall faced with precast concrete and supported with a grouted tieback anchor, and a method of constructing an earth retaining structure with improved corrosion protection for the anchorheads which attach the tiebacks to the soldier beam and the connections between concrete panels and tiedback soldier beams, and with improved drainage.

BACKGROUND OF THE INVENTION

Tiedback walls are commonly used as permanent earth retaining structures. In one known construction, the wall is built by first installing a plurality of laterally spaced soldier beams in the earth along a predetermined position of the wall to be constructed. The soldier beams may have various shapes and usually are either drilled or driven place. Earth is excavated adjacent the soldier beams to a designated depth and temporary earth retaining apparatus, such as lagging, is installed between the soldier beams against the exposed face of the earthen mass. The excavating and lagging installation steps are repeated until the tieback location is reached. A plurality of tiebacks is installed and anchored in the earthen mass and connected to the soldier beams. The excavating and tieback installation steps are repeated as necessary. When the location for the bottom of the wall is reached, precast concrete panels are attached to the soldier beams, or a reinforced concrete face made from cast-in-place concrete may be used.

The soldier beams, the connections between the soldier beams and the tiebacks, and the connections between the precast concrete panels and the soldier beams are located in a potentially corrosive environment, since both oxygen and groundwater are likely to be present. In the past, the soldier beams and these connections have been protected from corrosion by using coatings, galvanizing, or concrete encasement. However, these methods have numerous drawbacks. Most coatings on the soldier beams are damaged during the process of driving the soldier beams into the earthen mass. The coatings on the soldier beams in the vicinity of the connections and the coatings on the connection pieces must be removed in order to weld the connections to the soldier beam. In order to make the coatings effective, they must be repaired wherever they were damaged or removed. This procedure is expensive and it frequently does not result in an adequate coating. Galvanizing the soldier beam and the connections is difficult and is very expensive. Facilities with galvanizing tanks long enough to accommodate the soldier beams, often 50 feet long, are not readily available. Field cutting and welding of galvanized steel is difficult and the area affected by the cutting and welding must be field coated which is not very effective. Concrete encasement of the soldier beam-tieback connections and the soldier beam-panel connections is accomplished by completely filling the space between the panels, the soldier beams, and the temporary earth retaining apparatus with concrete along the entire length of the wall. If this space is completely filled, a large quantity of concrete is required and a separate drainage means must be provided behind the wall to prevent hydrostatic pressure from building up behind the panels. This increases the cost of constructing the earth retaining wall.

Prior art walls require either draining water under the wall through a pipe or draining water through the wall. The former method involves collecting the water behind the wall using a drainage material and discharging the water through a pipe located behind or in front of the wall. The latter method is accomplished by collecting the water behind the wall and discharging the water through the face of the wall either by drilling weep holes through the concrete wall in the field or prefabricating weep holes in the wall. These are expensive procedures.

SUMMARY OF THE INVENTION

It is an object of the present invention to provide an earth retaining wall with corrosion protection for the soldier beam-tieback connections and soldier beam-precast panel connections, and drainage which obviates the above discussed disadvantages of the prior art.

It is another object of the present invention to accomplish the above objects with a method of construction that is simple and economical to perform.

These and other objects of the present invention are accomplished by providing a method of constructing a wall for retaining an earthen mass which involves the following steps. A plurality of laterally spaced soldier beams is installed in the earth along a predetermined position of the wall to be constructed. A first stage of earth is excavated adjacent to the soldier beams to a predetermined depth. Temporary earth retaining apparatus, such as lagging, may be installed as needed between the soldier beams and against the exposed face of the earthen mass. These steps are repeated until the level of a tieback is reached. A plurality of tiebacks is placed and anchored in the earthen mass and are connected to the soldier beams. The above excavating, temporary retaining (if needed), and tieback installing steps are repeated sequentially in descending stages until the full height of the earth cut is retained. Next, inflatable bags are connected to the excavation face, precast panels, or lagging so that one bag is positioned adjacent each side of each soldier beam. Precast concrete panels are then positioned and attached to the soldier beams. The inflatable bags serve to seal the space between the precast concrete panels and the excavation face or lagging. The bags are then inflated with a cementitious or other material. The inflated bags seal between the concrete panels and the excavation along the entire height of the wall. The inflatable bags create two type of sealed channels between the excavation and the concrete panels. One channel contains the face of a soldier beam and the tieback and panel connections to the soldier beam. This channel is referred to as the soldier beam channel. The other channel is referred to as the drainage channel. Thus, the inflated bags create isolated areas surrounding the tieback-soldier beam connnections and the soldier beam-concrete panel connections. These isolated areas, i.e., the soldier beam channels, are then encased with grout, concrete, or other cementitious material to protect the connections from corrosion. The remainder of the spaces between the concrete panels and the excavation, i.e., the drainage channels, are filled with a drainage material such as gravel to permit water to be collected from behind the wall and discharged through a drain pipe or holes in the wall. The inflatable bags are preferred over field-built forms, which must be removed after placement of the concrete panels, to confine the concrete encasement to the area immediately in front of the soldier beams. Inflatable bags reduce construction costs and provide sealed channels which allow the use of improved construction methods. Before the material in the bags hardens, the bags conform to the shape of the area being sealed. This accommodates any irregularities.

In addition to providing corrosion protection for the tieback-soldier beam and the soldier beam-concrete panel connections, the cementitious material poured in the soldier beam channels may be reinforced with steel reinforcing bars to form a composite beam including the soldier beam and the reinforced concrete. This composite beam will carry a portion of the load applied to the soldier beams.

The precast concrete panels may be formed in one vertical piece or in sections. If one-piece panels are used, the inflatable bags preferably are attached to the concrete panels. If sectional concrete panels are used, the inflatable bags preferably are attached to the excavation face or lagging. Either way, the bags preferably are attached before the concrete panels are moved into position.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DESCRIPTION OF PREFERRED EMBODIMENTS

Figure 1:
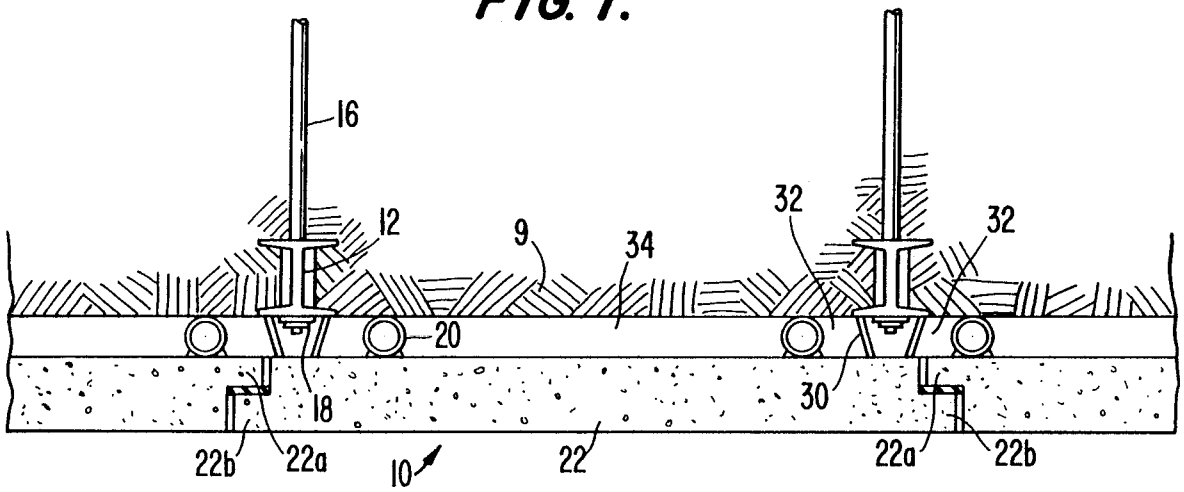
FIG. 1 shows a cross-sectional plan view of an earth retaining wall during its construction according to this invention.

Referring to the figures, retaining wall 10 according to this invention is constructed by first installing a plurality of soldier beams 12 in the earth along a predetermined position of the wall to be constructed. Soldier beams 12 typically are H or I-shaped in cross-section, but can assume any of various shapes and configurations and may be formed of a variety of materials. For example, as disclosed in U.S. Pat. No. 4,369,004 the soldier beams may be channel-shaped sheet piles made of pairs of interlocking steel pile segments. Soldier beams 12 may be installed in the earth either vertically or on a batter in any conventional manner, such as by means of a pile driver or by being inserted into pre-drilled holes in the earth and retained in place by concrete. Soldier beams 12 are placed at least as deep as the predetermined bottom of retaining wall 10. Preferably, soldier beams 12 are installed below this level to provide additional stability for retaining wall 10.

After soldier beams 12 have been installed, excavation is commenced to a predetermined depth, usually approximately five feet. Temporary earth retaining apparatus 14 may be installed, if needed, between soldier beams 12 along the entire length of retaining wall 10. Apparatus 14 is placed against the exposed face of earthen mass 9 as needed during excavation in order to prevent earthen mass 9 from collapsing. Such temporary earth retaining apparatus 14 may comprise conventional wood lagging, shotcrete, or gunite as is well-known in the art. These steps are repeated until a depth is reached that requires tiebacks 16 for stability. At this point, a first level of tiebacks 16 is installed and anchored in earthen mass 9. Any type of tieback may be used, but a tieback of the corrosion protected type is preferred for its long lasting strength and integrity. Tiebacks 16 extend through soldier beams 12 and are connected thereto by tieback connecting devices 18. These excavating, tieback installing, and temporary retaining steps are repeated sequentially in descending stages for the full height of earthen mass 9.

Figure 2:
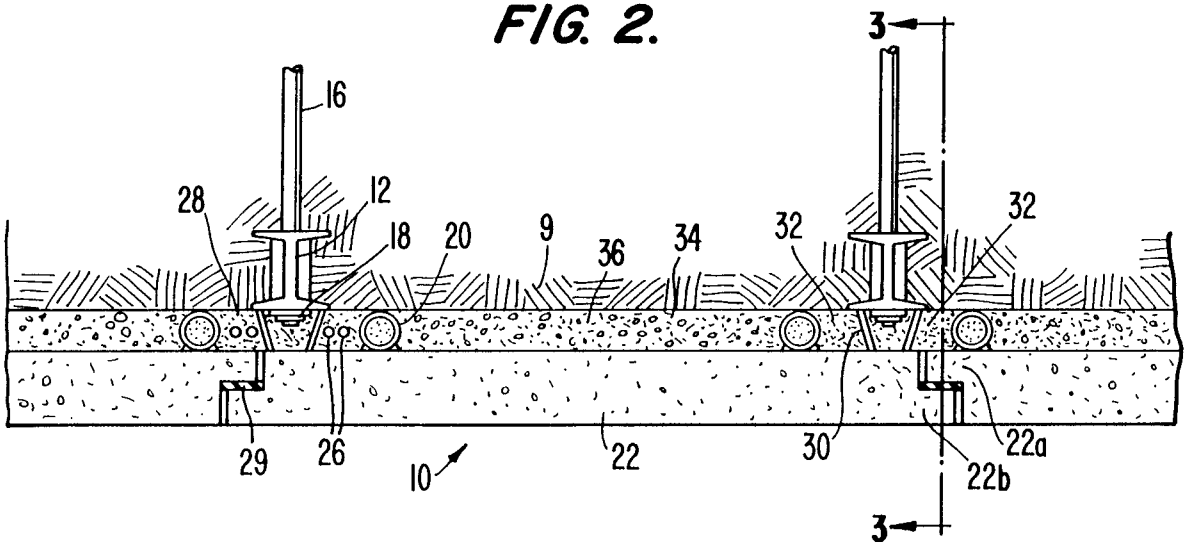
FIG. 2 shows a cross-sectional plan view of the completed earth retaining wall according to this invention.
Figure 3:
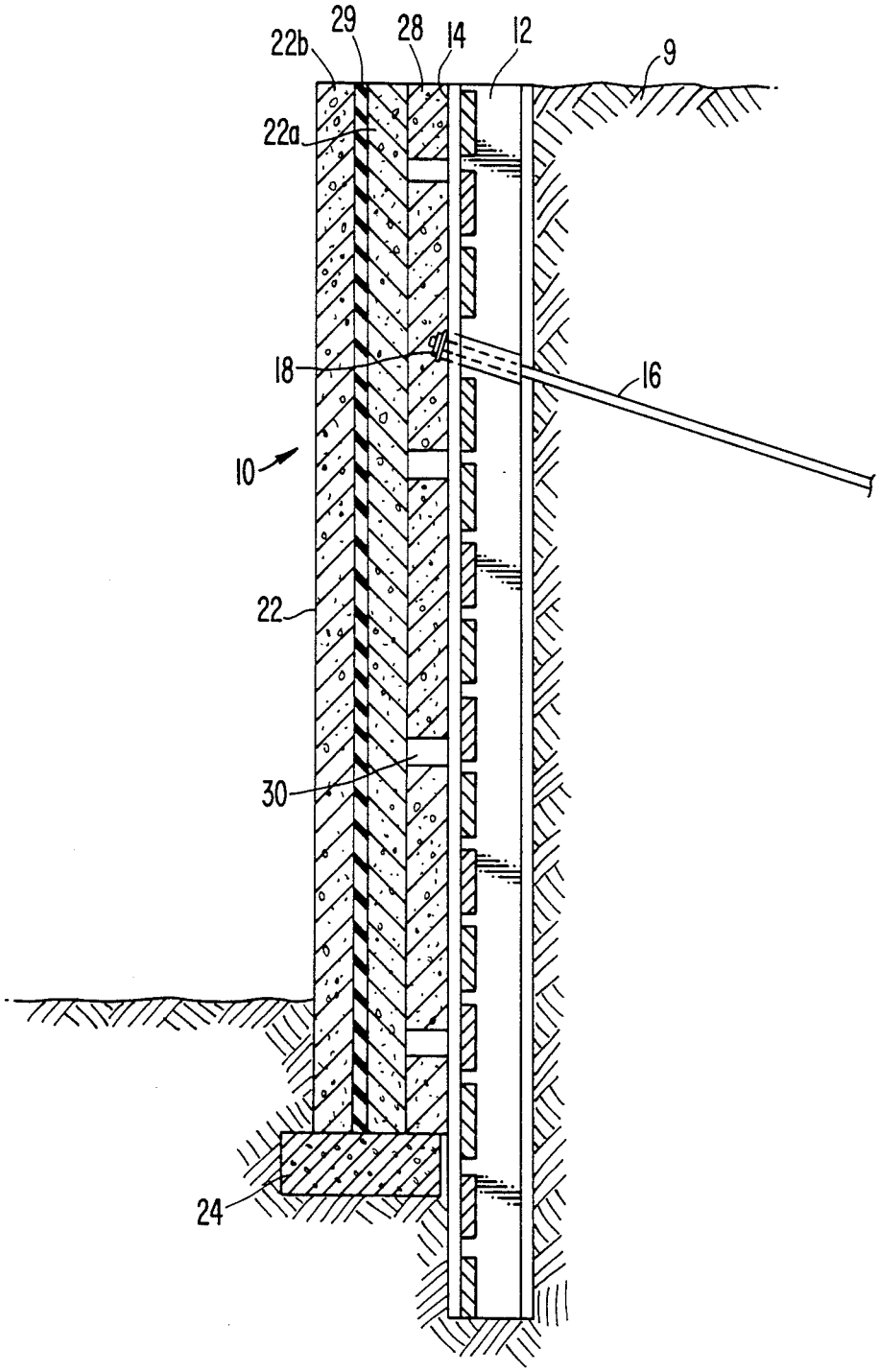
FIG. 3 shows a cross-sectional side view of an earth retaining wall according to this invention.

Next, inflatable bags 20 are connected to either the temporary earth retaining apparatus 14 if used, the excavation face, or the precast panels so that bags 20 will be positioned on either side of soldier beams 12 along the entire height of retaining wall 10. If the precast concrete panels 22 are formed in one full height section and not in numerous sections, it is preferred to attach inflatable bags 20 to precast concrete panels 22. Leveling pads 24 may be first placed at the bottom of the wall to support the vertical weight of panels 22. Next, reinforcing bars 26 may be provided between concrete panels 22 and soldier beams 12 to form a composite soldier beam further reinforcing retaining wall 10. Precast concrete panels 22 are then positioned adjacent temporary earth retaining apparatus 14, if used, or the excavation face and are connected to the soldier beams. As shown in the figures, alternate concrete panels 22 have two interior flanges **22*a* and the other alternate panels 22 have two exterior flanges 22*b*. Interior flange 22*a* of one panel interfits with exterior flange 22*b* of the adjacent panel. Thus, as shown in FIGS. 1 and 2 the exterior flanges 22*b* serve to retain the adjacent panels having flanges 22*a*. In an alternate embodiment each concrete panel 22 may have one interior flange 22*a* and one exterior flange 22*b*. Alternatively, panels 22 may have any of numerous other configurations. Adjacent panels are secured together by the bearing interface of the panels. A compressible material 29, such as neoprene, may be placed between the interface of the panels. In a preferred form, panels 22 are attached to soldier beams 12 by panel connecting devices 30** such as straps.

Inflatable bags 20 are then filled with a cementitious or other material to create first sealed vertical channels 32. Channels 32 surround connecting devices 18 and connecting devices 30 and include a surface of soldier beams 12 between the excavation and panels 22. Second sealed vertical channels 34 are also formed and serve as drainage channels between adjacent soldier beams. The areas between inflatable bags 20 surrounding soldier beams 12, i.e., soldier beam channels 32, are then filled with concrete, grout, or other cementitious material 28, encasing tieback connecting devices 18 and panel connecting devices 30 and the face of soldier beam 12. This creates a corrosion free environment around tieback connecting devices 18 and panel connecting devices 30 and insures that an open channel remains for placing drainage material. Reinforcing rods 26 may be placed within cementitious material 28 to form a composite beam and provide still further support for retaining wall 10. Studded shear connectors welded to soldier beam 12 enable the reinforced concrete beam to function as a composite beam with the soldier beam 12. Finally, drainage material such as gravel 36 is placed in drainage channels 34. This provides for adequate drainage behind retaining wall 10.

Numerous characteristics, advantages, and embodiments of the invention have been described in detail in the foregoing description with references to the accompanying drawings. The disclosure, however, is illustrative only and it is to be understood that the invention is not limited to the precise illustrated embodiments. Various changes and modifications may be effected therein by one skilled in the art without departing from the scope or spirit of the invention.

I claim:

1. A method of constructing a wall for retaining an earthen mass comprising;

installing a plurality of laterally spaced beam members in the earth along a predetermined position of the wall to be constructed;

excavating earth adjacent to said beam members to a desired depth;

installing and anchoring a plurality of tiebacks in the earthen mass;

connecting said tiebacks to said beam members by first connecting means;

positioning elongated, inflatable members between the earthen mass and a precast panel to be fixed to said beam members;

positioning and attaching precast panels to said beam members by second connecting means;

inflating said inflatable members thereby creating first sealed vertical channels surrounding said first connecting means and said second connecting means, said first channels being between the earthen mass and said panels, said inflatable members further creating second sealed vertical channels between adjacent beam members between the earthen mass and said panels; and filling said first channels with a cementitious material to encase and protect said first connecting means and said second connecting means.

2. A method according to claim 1 further comprising the step of filling said second channels with drainage material to provide vertical drainage channels behind said panels.

3. A method according to claim 1 further comprising repeating the steps of excavating the earth and installing said tiebacks in descending stages.

4. A method according to claim 1 wherein said step of creating first and second vertical channels comprises creating said channels over the full depth of the excavation.

5. A method according to claim 1 further comprising the step of installing temporary earth retaining means against the exposed face of the earthen mass.

6. A method according to claim 5 wherein said step of positioning said inflatable members comprises attaching said inflatable members to said temporary earth retaining means.

7. A method according to claim 1 wherein said step of positioning said inflatable members comprises attaching said inflatable members to the exposed face of the earthen mass.

8. A method according to claim 1 wherein said step of positioning said inflatable members comprises attaching said inflatable members to said concrete panels.

9. A method according to claim 1 wherein said inflatable members comprise inflatable bags.

10. A method according to claim 9 wherein said inflatable bags are inflated with a cementitious material.

11. A method according to claim 1 further comprising the step of installing reinforcement rods in said first vertical channels to form reinforced concrete beams connected to said beam members thus forming composite beams.

12. A method of constructing a wall for retaining an earthen mass comprising:

installing a plurality of laterally spaced beam members in the earth along a predetermined position of the wall to be constructed;

excavating earth adjacent to said beam members to a desired depth;

positioning precast panels adjacent said beam members;

affixing inflatable bags between the excavation and the precast panels;

attaching said precast panels to said beam members with panel connecting means;

inflating said inflatable bags thereby creating a sealed first channel between said excavation and said concrete panels, said first channel surrounding said panel connecting means, and a sealed second channel between adjacent beam members;

filling said first channel with a material to encase and protect said panel connecting means; and filling said second channel with drainage material to provide vertical drainage channels behind said panels.

13. A method according to claim 12 further comprising the steps of:

installing and anchoring a plurality of tiebacks in the earthen mass; and connecting said tiebacks to said beam members by a tieback connecting means, whereby said material filling said first channel encases and protects said tieback connecting means.

14. A method according to claim 12 further comprising the step of installing reinforcing rods in said first channels to form reinforced concrete beams connected to said beam members thus forming composite beams.

15. A wall structure for retaining an earthen mass comprising:

a plurality of laterally spaced beam members installed in the earthen mass;

a wall of precast panels adjacent said beam members;

panel connecting means for connecting said panels to said beam members;

inflatable members inflated and disposed between the earthen mass and said panels to form first sealed vertical channels surrounding said panel connecting means, said first channels being between the earthen mass and said panels, said inflatable members further forming second sealed vertical channels between adjacent beam members and between the earthen mass and said panels;

a filling material filling said first channels to encase and protect said panel connecting means; and drainage material filling said second channels.

16. A wall structure according to claim 15 further comprising temporary earth retaining means disposed against the face of the earthen mass.

17. A wall structure according to claim 15 further comprising reinforcement rods in said first sealed vertical channels, said rods and said filling material forming reinforced beams, and connecting means connecting said reinforced beams and said beam members to thereby form composite beams which carry a portion of the load applied to said beam members.

18. A wall structure according to claim 15 further comprising:

a plurality of tiebacks anchored in the earthen mass; and tieback connecting means for connecting said tiebacks to said beam members wherein said first channels also surround said tieback connecting means whereby said material filling said first channels also encases and protects said tieback connecting means.

* * * * *